US006150991A

United States Patent [19]

Hulderman

[11] Patent Number: 6,150,991

[45] Date of Patent: Nov. 21, 2000

[54] ELECTRONICALLY SCANNED CASSEGRAIN ANTENNA WITH FULL APERTURE SECONDARY/RADOME

[75] Inventor: Garry N. Hulderman, Riverside, Calif.

[73] Assignee: Raytheon Company, Lexington, Mass.

[21] Appl. No.: 09/191,069

[22] Filed: Nov. 12, 1998

[51] Int. Cl.[7] ..... H01Q 19/00

[52] U.S. Cl. ..... 343/781 CA; 343/755; 343/756; 343/757

[58] Field of Search ..... 343/781 CA, 909, 343/781 P, 781 R, 756, 872, 755, 757, 779; H01Q 19/00

[56] References Cited

U.S. PATENT DOCUMENTS

| | | | |
|---|---|---|---|
| 4,220,957 | 9/1980 | Britt | 343/756 |
| 4,665,405 | 5/1987 | Drabowitch Serge et al. . | |
| 5,373,302 | 12/1994 | Wu | 343/781 P |
| 5,666,124 | 9/1997 | Chethik et al. | 342/383 |

FOREIGN PATENT DOCUMENTS

| | | |
|---|---|---|
| 0 080 319 | 9/1994 | European Pat. Off. . |
| 2 276 436 | 9/1994 | United Kingdom . |
| WO 95 18980 | 7/1995 | United Kingdom . |
| WO 98 49750 | 11/1998 | WIPO . |

OTHER PUBLICATIONS

"Introduction To Radar Systems," Second Edition, Merrill I. Skolnik, McGraw–HillBook Company, 1980, pp 240–245.
XP002131440 Hansen R C 1964.
XP 002131439 Dahlsjo O Oct. 1973.

*Primary Examiner*—Hoanganh Le
*Attorney, Agent, or Firm*—David W. Collins; Andrew J. Rudd; Glenn H. Lenzen, Jr

[57] ABSTRACT

A Cassegrain antenna system includes a flat dielectric plate radome having a thickness of one-half wavelength at a frequency of operation. The plate has an electrically conductive grid disposed on an inside surface thereof to permit perpendicularly polarized energy rays to pass there-through. A parabolic twist reflector is spaced from the radome, and includes a dielectric substrate having a thickness equivalent to one-quarter wavelength at a frequency of operation and having formed on an interior surface thereof an array of conductive strips oriented by 45 degrees relative to the incident ray polarization. A conductive ground layer is formed on an exterior surface of the substrate, wherein radiation reflected by the ground layer and passing through the dielectric substrate is shifted by 180 degrees in phase and is rotated in polarization when combined with energy reflected from the conductive strip array by 90 degrees relative to radiation incident on the twist reflector. The reflected energy from the polarization twist reflector is again reflected, this time by the grid formed on the radome surface, to a focal region. An RF housing with a plurality of RF feed elements is located at the focal region and are respectively spaced by a single beamwidth.

17 Claims, 4 Drawing Sheets

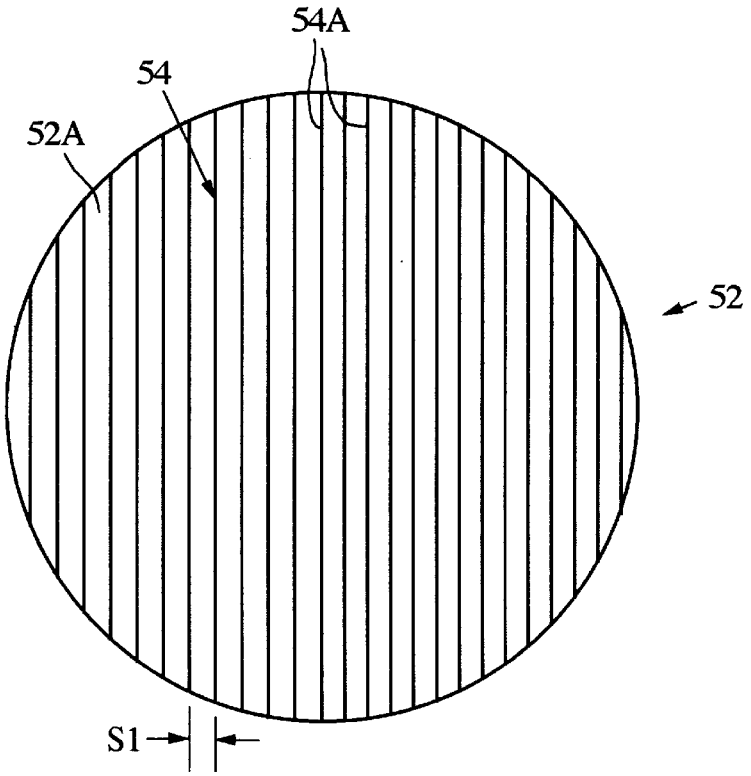
FIG. 2
FIG. 5
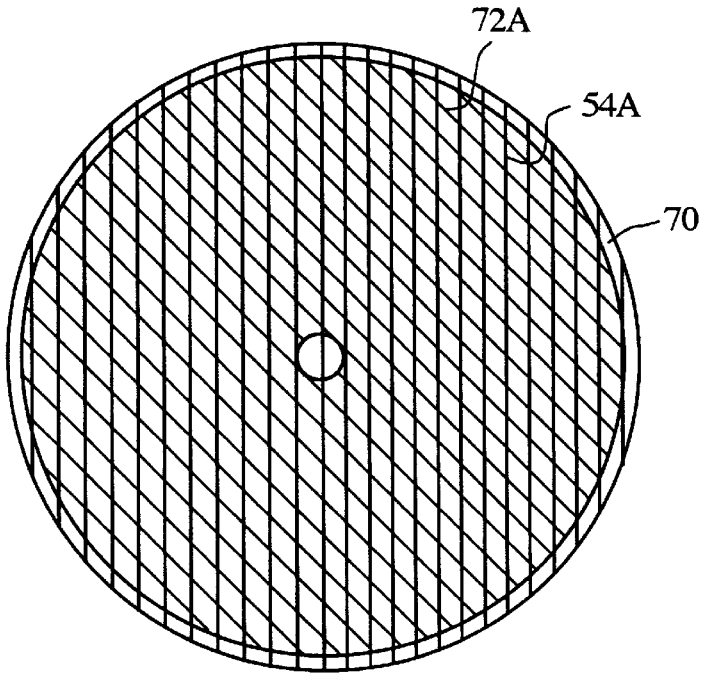

ELECTRONICALLY SCANNED CASSEGRAIN ANTENNA WITH FULL APERTURE SECONDARY/RADOME

TECHNICAL FIELD OF THE INVENTION

This invention relates to antennas used in active and passive sensor systems, and more particularly to an efficient low physical profile antenna capable of low sidelobe operation over a wide field-of-view.

BACKGROUND OF THE INVENTION

Antennas that require large focal plane offsets, necessary for beam scanning, also require long focal lengths (high F-numbers) to minimize aberrations for acceptable beam quality of the antenna pattern. High F-numbers increase the antenna length or thickness to dimensions that in many cases are unacceptable.

There are several forms of "polarization twist" Cassegrain antennas presently in use today. In one type, the secondary sub-reflector reflects the focused rays from the primary paraboloidal reflector back to a focal point in the region of the primary reflector's vertex. By twisting the polarization, the blockage as a result of the secondary reflector shadowing the rays on the primary parabola is greatly reduced. This known approach incorporates small F-number primary apertures (0.3 to 0.4) to minimize the antenna thickness. This is followed by a 2 to 4 times gain small diameter hyperboloidal secondary reflector to increase the ray path length to the focal point near the primary vertex. The quality of the antenna pattern, which includes gain and sidelobes over the scanned angle, is strongly influenced by the primary reflector's F-number, not the effective F-number. Assuming a known Cassegrain antenna with a 0.35 F-number, the field-of-view would be limited to 4 beamwidths (to achieve same beam quality as the 9 beamwidth embodiment described below in accordance with the invention) and have about a 10% greater length.

SUMMARY OF THE INVENTION

A Cassegrain antenna system is described in accordance with the invention, and includes a flat dielectric plate radome having a thickness of one-half wavelength at a frequency of operation. The plate has an electrically conductive grid disposed on an inside surface thereof to permit perpendicularly polarized energy rays to pass therethrough. A parabolic twist reflector is spaced from the radome, and includes a dielectric substrate having a thickness equivalent to one-quarter wavelength at a frequency of operation and having formed on an interior surface thereof an array of conductive strips oriented by 45 degrees relative to the incident ray polarization. A conductive ground layer is formed on an exterior surface of the substrate, wherein radiation reflected by the ground layer and passing through the dielectric substrate is shifted by 180 degrees in phase and is rotated in polarization when combined with energy reflected from the conductive strip array by 90 degrees relative to radiation incident on the twist reflector. The reflected energy from the polarization twist reflector is again reflected, this time by the grid formed on the radome surface, to a focal region. An RF housing comprising a plurality of RF feed elements is located at the focal region and respectively spaced by a single beamwidth.

BRIEF DESCRIPTION OF THE DRAWING

These and other features and advantages of the present invention will become more apparent from the following detailed description of an exemplary embodiment thereof, as illustrated in the accompanying drawings, in which:

FIG. 2 is a rear plan view of the radome comprising the system of FIG. 1, and illustrates in exaggerated form the wire grid applied to the rear surface of the radome.

FIG. 5 is an overlay illustration of the radome conductive grid overlaid on the parabolic reflector and its conductive grid, showing the 45 degree relative orientation of the two grids.

DETAILED DESCRIPTION OF THE PREFERRED EMBODIMENT

Figure 1:
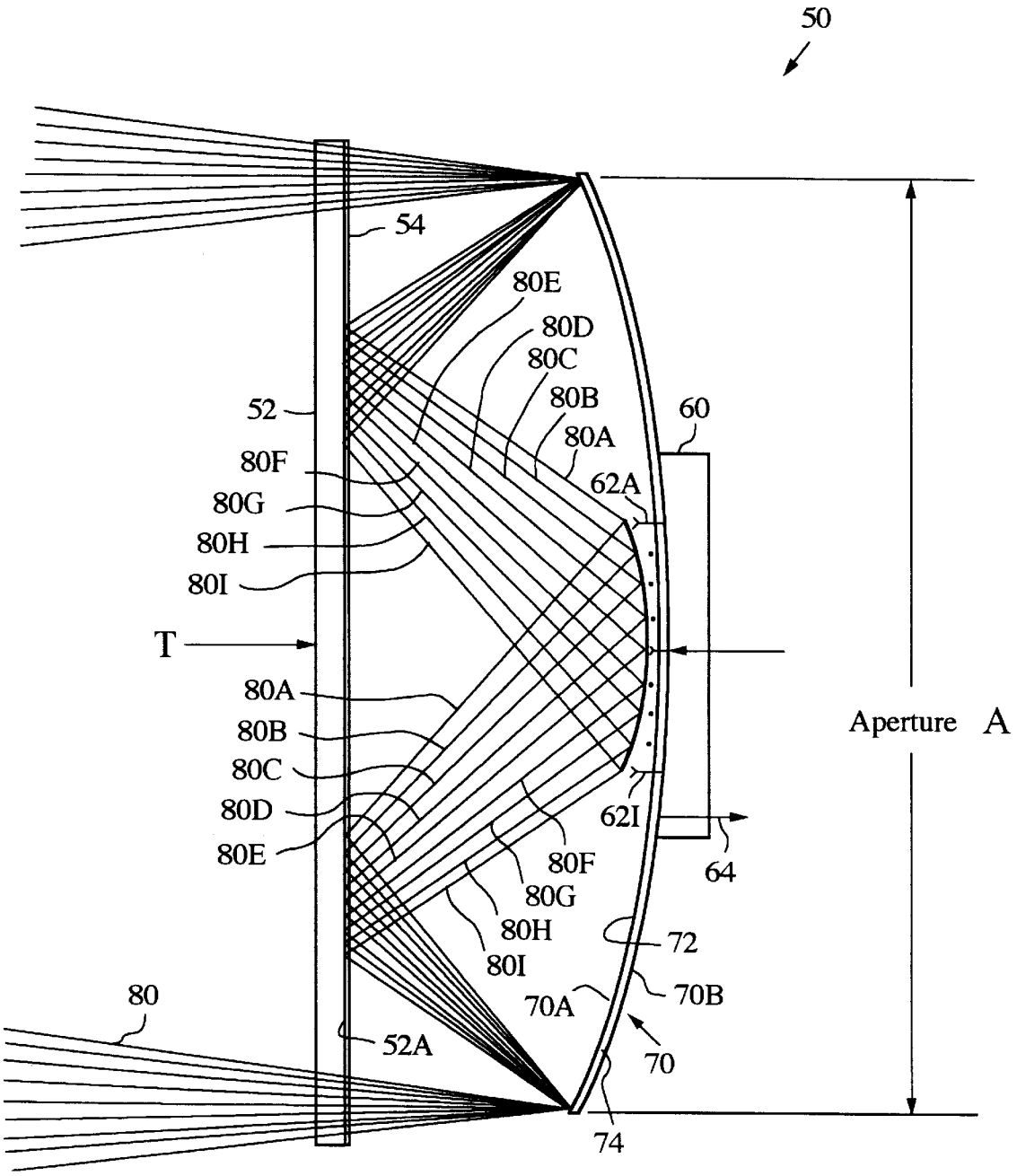
FIG. 1 is a diagrammatic side view illustration of an antenna system in accordance with the invention.

FIG. 1 shows an exemplary Cassegrain antenna system 50 in accordance with the invention. The system 50 is electronically scanned, and has an integrated radome 52. An RF housing 60 provides, in this exemplary embodiment, nine RF feed elements 62A–62I which illuminate the aperture of size A (FIG. 1) on transmit, and which form a receive beam on receive at port 64. The system further includes a polarization twist paraboloidal reflector 70.

Some exemplary received energy rays are illustrated in FIG. 1; for clarity, only the rays 80 around the outer aperture edge are shown. The nine rays 80A–80I from the respective feed elements 62A–62I are offset in angle by one beamwidth step position. On receive, the rays enter from the left and pass through the one-half wavelength thick, flat dielectric plate radome 52. A copper wire grid 54 is printed on the inside surface 52A of the radome to allow the perpendicularly polarized rays to pass through. The rays then strike the surface 70A of the parabolic twist reflector 70 which reflects and also rotates by 90 degrees their polarization.

The polarization twist reflector 70 includes, on the inside surface 70A, a wire grid or array 72 of printed strips or wires oriented by 45 degrees relative to the ray polarization. These strips are printed on a quarter wavelength thick dielectric substrate 74 with the outside surface 70B covered with a thin layer 76 of plated copper. The reflected energy through the dielectric is shifted by 180 degrees and when combined with the energy on the inside surface, rotates the polarization by 90 degrees.

The radiation now focused by the parabolic shape (f#= 0.65 in this exemplary embodiment) is reflected back to the inner surface 52A of the flat dielectric plate 52. Due to the rotation, the polarization of the rays is now parallel to the strips of the printed wire grid 54. The spacing of the grid strips is such that, relative to the wavelength, it appears as a solid metal surface when the field is parallel to the wires. The reflected focused rays from the plate's wire grid 54 arrive at their respective focal points at the corresponding feed element 62A–62I with minimum distortion.

With the antenna system pointed at a point source, the power distribution at the focal plane or individual feed phase center forms an Airy disc. The disc diameter at the −3 dB crossover points is 0.19 inch in this example. The beamwidth of the individual feeds must be narrow enough to capture the power of an individual Airy disc pattern, but not so wide as to include a neighboring disc. The Airy disc formed in the focal plane of each one beamwidth offset ray angle (−3 db beam overlap) is of adequate separation to provide sufficient feed aperture size to support up to a −14 db illumination taper on the parabola. This is in contrast to the known type of Cassegrain antenna, where the feed separation (required for one-beamwidth offsets) is so small (as a result of the low primary f/D ratio) coupled with the need for large feed dimensions (to properly illuminate the small high gain secondary) forces the impossible situation of overlapping the feed array (i.e., with the feeds occupying the same space).

As the F number of the parabola is increased, the feed diameter must be increased to produce a narrower beam (longer focal length). The problem which results for conventional Cassegrain antennas is that the feed separation stays about the same, resulting in feed overlapping.

FIG. 2 is a rear plan view of the radome 52, and illustrates in exaggerated form the wire grid 54 applied to the rear surface 52A of the radome. In this embodiment, the wire grid 54 is formed by copper traces 54A applied, e.g. by a photolithographic process, to the rear surface. The traces 54A here are 0.005 inch wide, and are spaced by a distance S1 0.012 inch center/center. The spacing is shown in exaggerated form in FIG. 2 to illustrate the grid. For this embodiment, the radome 52 has a thickness of 0.128 inch, which is one half wavelength at a center frequency of operation of 94 GHz, and a bandwidth of 2 GHz.

Figure 4:
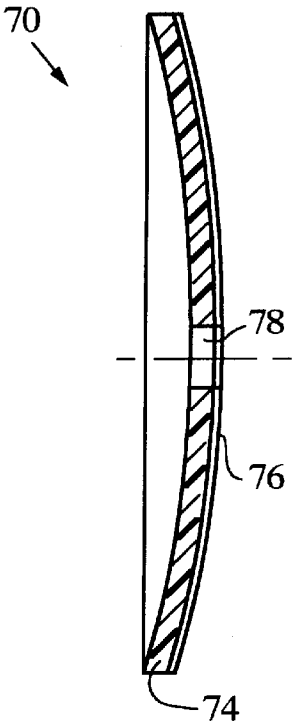
FIG. 4 is a cross-sectional view taken along line 4—4 of FIG. 3.
Figure 3:
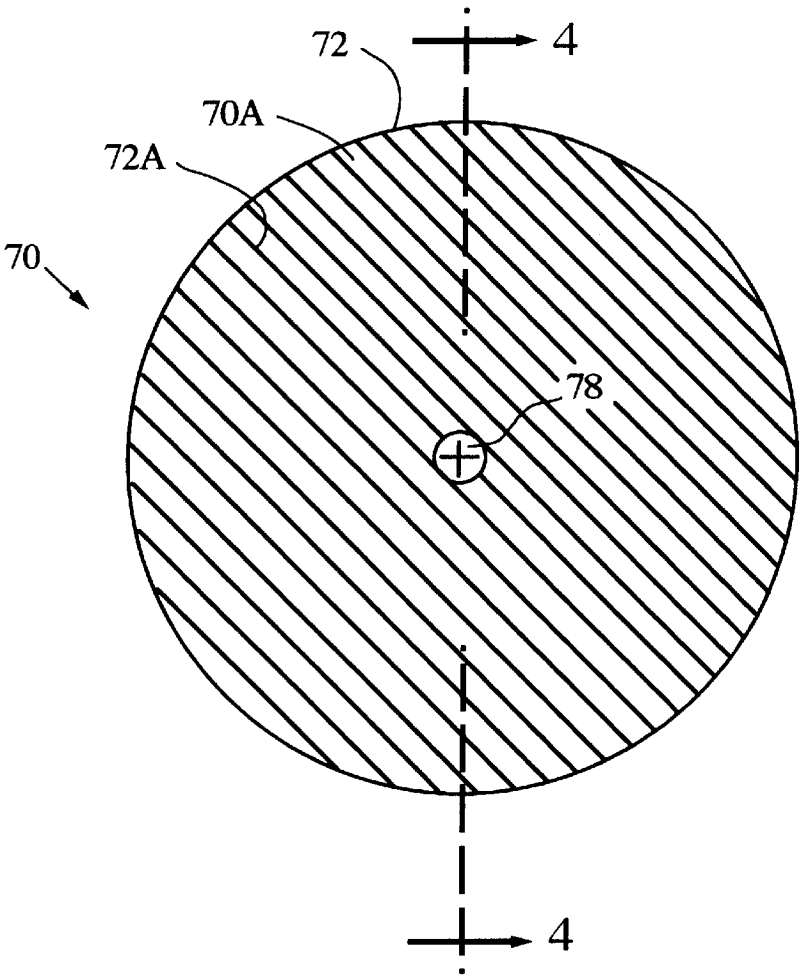
FIG. 3 is a front plan view of the paraboloidal polarization twist reflector comprising the system of FIG. 1.

FIG. 3 is a front plan view of the paraboloidal polarization twist reflector 70, and FIG. 4 is a cross-sectional view taken along line 4—4 of FIG. 3. FIG. 3 shows, on the inside surface 70A of the reflector facing the radome, the array 72 of printed strips or wires 72A. In this embodiment, the reflector 70 has a depth of 0.463 inch, the substrate 74 has a thickness of 0.100 inch, and the wires 72A have a thickness of 0.005 inch, and are spaced by 0.012 inch center/center. An opening 78 is formed in the substrate 74 to accommodate the feed element of the housing 60.

The array 72 of wires formed on the reflector 70 is oriented by 45 degrees relative to the ray polarization, and relative to the orientation of the array 54 on the radome 52. This is illustrated in FIG. 5, which is an overlay illustration of the array 54 on the reflector 70 and array 72. As illustrated in FIG. 5, the radome 52, which serves as the secondary reflector, has a circular periphery similar in size to the periphery of the primary parabolic reflector 70. This minimizes aberrations at much greater offset angles (scan angles), reduces sidelobes as a result of much greater illumination tapers, i.e. the energy distribution of a single feed on the primary parabolic reflector, without physical interference of individual feeds, and reduces the thickness of the antenna system.

The parabolic reflector 70 of the exemplary embodiment has an aperture diameter of 5.0 inch and a focal length of 3.1 inches, with a feed separation of 0.125 inch. With the f# equal to the ratio of the focal length and the diameter, the reflector 70 has an f# equal to about 0.65.

An exemplary dielectric material suitable for use in the flat dielectric plate 52 and the substrate 74 of the polarization twist reflector is Rexolite (TM) #1422, with a relative dielectric constant of about 2.5 at exemplary frequencies on the order of 94±1 GHz. The collective losses of the radome and parabolic reflector, including printed lines, are expected to be relatively low, e.g. 0.4 db. The transmission coefficient, for parallel polarization incident to the flat plate wire grid 54, is expected to be on the order of −24 db for this example.

Figure 6:
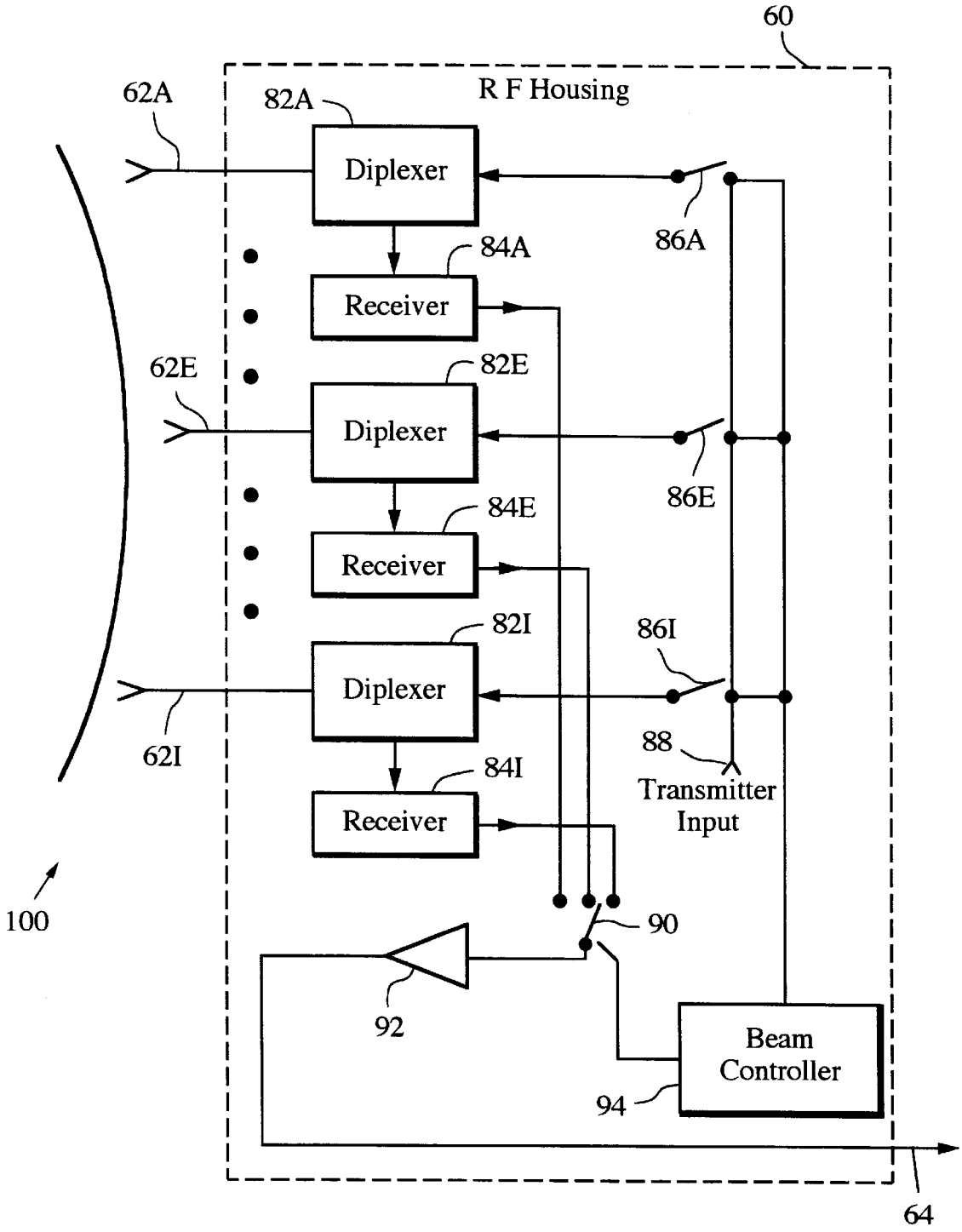
FIG. 6 is a schematic diagram of an exemplary radar system employing the antenna system of FIG. 1.

FIG. 6 illustrates an exemplary form of the RF housing 60, suitable for a radar application. Each feed element 62A–66I is connected to a corresponding signal diplexer 82A–82I. Each signal diplexer routs transmit signals from a corresponding transmitter beam position switch 86A–86I and the transmitter input 88 to the feed element. The diplexers also send received signals from the corresponding feed element 62A–62I to a receiver 84A–84I. The outputs of the receivers are routed through a receive beam position switch 90 and an amplifier 92 to the receiver beam position output port 64. A beam controller 94 is connected to control ports of the switches 86A–86I and 90 to select a particular transmit or receive beam, and thus electronically scan the beam.

An efficient, low physical profile antenna assembly has been described. In an exemplary embodiment, the antenna assembly has an outside dimension thickness-to-aperture ratio of 0.35 [T/A (FIG. 1)=0.35], is capable of low sidelobes (17 db at the outermost beam positions) over an electronically stepped field-of-view of nine beamwidths.

The invention can be employed in active and passive sensors and seekers, including imagers. Particular exemplary applications include automotive cruise control and automotive/aircraft collision warning.

While the disclosed embodiment utilizes a planar radome surface, other embodiments can employ non-planar surfaces. For example, the radome surface could alternatively be a parabolic surface, which would change the focal length of the antenna. The use of a curved surface could reduce the antenna thickness even more than with a flat radome surface, and may be suitable for applications requiring fewer beams or a single beam, with correspondingly fewer feed elements.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An electronically scanned Cassegrain antenna system, comprising:

a dielectric radome, said radome having a first electrically conductive grid to permit incident perpendicularly polarized energy rays to pass therethrough;

a twist reflector spaced from the radome, said reflector comprising a dielectric substrate having a thickness equivalent to one-quarter wavelength at said frequency of operation and having formed on an interior surface thereof a second electrically conductive grid oriented by 45 degrees relative to an incident polarization of said incident energy rays, and a conductive ground layer formed on an exterior surface of the substrate;

wherein said radome and said twist reflector are adapted such that radiation reflected by the ground layer and passing through the dielectric substrate is shifted by 180 degrees in phase and is rotated in polarization when combined with energy reflected from the second conductive grid by 90 degrees relative to radiation incident on said twist reflector, and wherein said reflected energy from the polarization twist reflector is reflected by said first grid formed on said radome surface to a focal region;

an electromagnetic feed structure located at said focal region, said feed structure including a plurality of spaced feed elements, each feed element for providing a corresponding discrete antenna beam such that the plurality of feed elements produce a corresponding plurality of angularly offset antenna beams at corresponding scan angles;

switching apparatus coupled to the plurality of feed elements; and a beam controller coupled to the switching apparatus for selecting one of said feed elements to electronically select a desired antenna beam at a selected scan angle.

2. The system of claim 1 wherein said dielectric radome has a thickness of one-half wavelength at a frequency of operation.

3. The system of claim 1 wherein said radome has a perimeter which is generally similar in size to a perimeter of the twist reflector.

4. The system of claim 1 wherein said feed structure comprises an RF housing mounting said plurality of feed elements at said focal region and respectively spaced by a single beamwidth.

5. The system of claim 1 wherein the radome comprises a flat dielectric plate.

6. The system of claim 1 wherein said twist reflector is a parabolic twist reflector, the dielectric substrate having a parabolic shape, and the radome includes a flat dielectric plate on which said first grid is formed.

7. The system of claim 1 wherein said system is operable at a frequency range centered at 94 Ghz.

8. The system of claim 1 wherein the antenna system is adapted for both receive and transmit operation, and wherein the beam controller is adapted to select one of the plurality of feed elements for providing a receive beam at the corresponding beam scan angle, and to select one of the plurality of feed elements for coupling to a transmit signal source to transmit a beam at the corresponding beam scan angle.

9. An electronically scanned Cassegrain antenna system, comprising:

a flat dielectric plate radome, said plate having a first electrically conductive grid disposed on an inside surface thereof to permit incident perpendicularly polarized energy rays to pass therethrough;

a parabolic twist reflector spaced from the radome, said reflector comprising a dielectric substrate having a thickness equivalent to one-quarter wavelength at said frequency of operation and having formed on an interior surface thereof a second electrically conductive grid oriented by 45 degrees relative to an incident polarization of said incident energy rays, and a conductive ground layer formed on an exterior surface of the substrate;

wherein said radome and said parabolic twist reflector are adapted such that radiation reflected by the ground layer and passing through the dielectric substrate is shifted by 180 degrees in phase and is rotated in polarization when combined with energy reflected from the second conductive grid by 90 degrees relative to radiation incident on said twist reflector, and wherein said reflected energy from the twist reflector is reflected by said first grid formed on said radome surface to a focal region;

an RF housing comprising a plurality of spaced RF feed elements located at said focal region, each feed element for providing a corresponding discrete antenna beam such that the plurality of feed elements produce a corresponding plurality of angularly offset antenna beams at corresponding scan angles;

switch circuitry coupled to the plurality of RF feed elements; and a beam controller coupled to the switch circuitry for selecting one of said plurality of antenna beams to electronically scan the antenna to a desired antenna scan angle.

10. The system of claim 6 further comprising a plurality of signal diplexers each coupled to a corresponding feed element for separating transmit and received signals.

11. The system of claim 10 further comprising a plurality of receivers coupled respectively to a receive port of a corresponding diplexer to receive signals from a corresponding feed element and provide a receiver output signal, and wherein said switch circuitry includes a switch apparatus for selecting one of said receiver output signals as a system receive output signal at said selected scan angle.

12. The system of claim 10 wherein the switch circuitry further comprises a transmit switch apparatus for selectively coupling a transmit signal to a transmit port of a selected diplexer for coupling to a corresponding feed element to transmit a beam at the scan angle of the corresponding feed element.

13. The system of claim 9 wherein said radome substrate has a thickness of one-half wavelength at a frequency of operation.

14. The system of claim 9 wherein said radome has a perimeter which is generally similar in size to a perimeter of the parabolic twist reflector.

15. The system of claim 9 wherein the plurality of RF feed elements are spaced by a single beamwidth.

16. The system of claim 9 wherein the antenna system is adapted for both receive and transmit operation, and wherein the switch circuitry is adapted to select one of the plurality of RF feed elements for providing a receive beam at the corresponding beam scan angle, and to select one of the plurality of RF feed elements for coupling to a transmit signal source to transmit a beam at the corresponding beam scan angle.

17. The system of claim 9 wherein said system is operable at 94 Ghz.

* * * * *